United States Patent [19]

Forrer

[11] Patent Number: 4,572,491

[45] Date of Patent: Feb. 25, 1986

[54] DEVICE FOR JOINING WOODEN OR METALLIC STRUCTURAL PARTS

[76] Inventor: Hans Forrer, Feldweg 854, Oberhelfenschwil, Switzerland

[21] Appl. No.: 588,041

[22] Filed: Mar. 9, 1984

[30] Foreign Application Priority Data

Mar. 10, 1983 [CH] Switzerland ..... 1431/83

[51] Int. Cl.[4] ..... B25B 1/20

[52] U.S. Cl. ..... 269/43; 269/41; 269/131

[58] Field of Search ..... 269/130–132, 269/108–109, 243, 41–42, 43

[56] References Cited

U.S. PATENT DOCUMENTS

| | | | |
|---|---|---|---|
| 1,117,662 | 11/1914 | Graham | 269/132 |
| 2,753,902 | 7/1956 | Klee | 269/243 |
| 3,610,612 | 10/1971 | Day | 269/109 |
| 3,722,562 | 3/1973 | Stegmuller | 269/108 |
| 4,027,866 | 6/1977 | Ruggiero | 269/41 |
| 4,047,710 | 9/1977 | Wilson | 269/108 |

FOREIGN PATENT DOCUMENTS

| | | | |
|---|---|---|---|
| 4636 | of 1902 | United Kingdom | 269/108 |
| 877476 | 9/1961 | United Kingdom | 269/132 |

*Primary Examiner*—Robert C. Watson

*Attorney, Agent, or Firm*—McGlew and Tuttle

[57] ABSTRACT

A clamping device comprises an angle member carrying a clamping mechanism and a clamping band which is engaged by the clamping mechanism at one end and engages around and holds the workpieces to be joined firmly in contact with each other, and is attached, by its other end, to an anchor. The anchor may be provided on the angle member or on a tensioning angle member. To tension the band, the clamping mechanism is mounted on a slide 3 which is displaceable by a pulling means operating thereon and which comprises a screw and a nut.

4 Claims, 7 Drawing Figures

DEVICE FOR JOINING WOODEN OR METALLIC STRUCTURAL PARTS

FIELD AND BACKGROUND OF THE DISCLOSURE

The invention relates in general to assemblying devices and in particular to a new and useful device for joining wooden or metallic structural parts, permitting the application of a necessary contact pressure on the joint without causing undesirable displacements.

While working on and setting up structures, be it for conjointly machining, such as drilling, several parts at the same time, or letting solidify glued joints, or performing other operations requiring the pressing of two or more parts together, it is necessary to produce a contact pressure. In structures of small and medium size, especially in woodworking, well known screw clamps are employed. These clamps can further be assembled, for example by other clamping means, to double or even multiple clamps.

To master securing in larger structures, screw clamps of considerable dimensions are available having a throat width of the magnitude of one meter. Such tools are correspondingly massive, heavy and expensive. They are unhandy and require manual force at a growing rate. Further, the interconnection of two or more screw clamps to a clamping system leads partly to complicated topological problems which sometimes cannot be solved satisfactorily. Also, limits are set to the size, i.e. the mutual spacing of the jaws of a screw clamp, so that screw clamps can no longer be taken into account as clamping or compressing devices in certain assemblages.

SUMMARY OF THE INVENTION

The invention is directed to a device with which the joining of wooden and/or metallic parts is simplified and the problems arising with larger dimensions to be handled increase at a much lower rate than with prior art screw clamp systems.

The invention is further directed to a device usable for mastering working problems which arise with increasing structural dimensions, and requiring an only reduced number of tool sizes; in other words, as compared to the prior art, eliminating the need for a full series of tools in fine gradation.

Finally, the inventive device is a light-weight structure, and instrumental in reducing costs of labor.

In accordance with the invention, a device for joining structural parts together includes a clamp which advantageously includes an eccentric member is engageable over a slide to a clamp at one end of a band which has been engaged around two parts to be clamped together and has an opposite end which is anchored. The device advantageously includes an anchor member which is angled shape and is adapted to engage the corner of one of the parts. Advantageously it also includes a mounting for a slide of the clamp for engaging the wire which is connected through a spindle member to one leg of the angle member in a manner so that the slide may be shifted to tension the band after it has been clamped.

An object of the invention is to provide an improved clamping device which includes a band which engages around two parts which are to be clamped together and which is arranged in cooperation with an angle member which engages a corner of one of the parts so that a band which is engaged around the other of the parts may be tightened against the angle member and the parts to hold them in position.

A further object of the invention is to provide a clamping device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
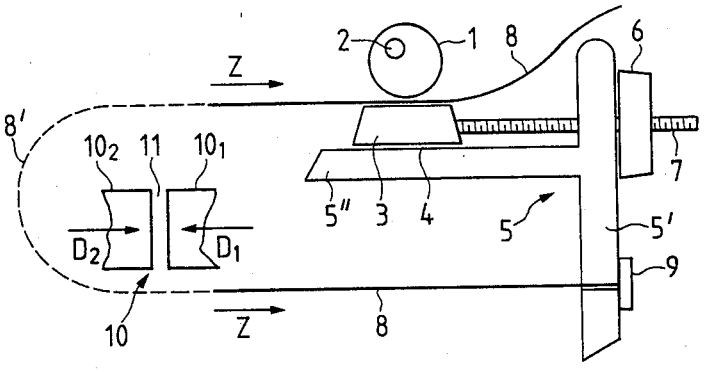
FIG. 1 is a schematic side elevation of an inventive clamping device.
Figure 2:
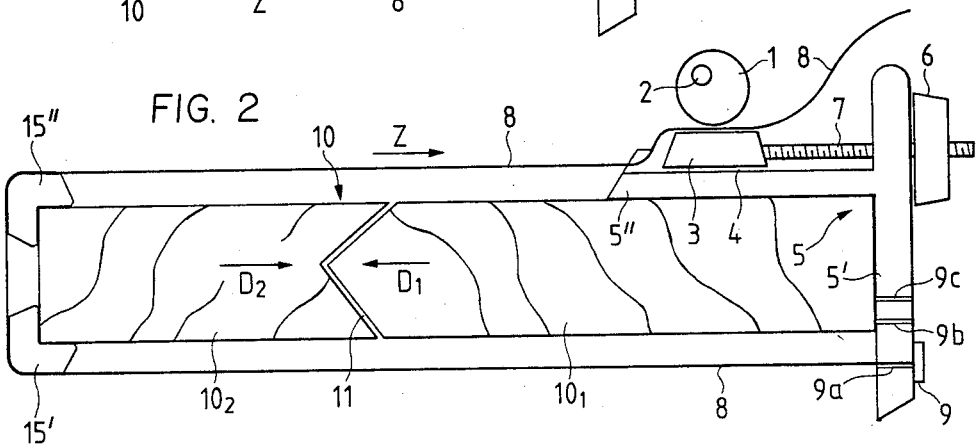
FIG. 2 is an annular view of an application of the device to a joint between two structural parts.

Referring to the drawings in particular the invention embodied therein in FIGS. 1 and 2 comprises a device for joining structural parts 10-1 and 10-2 into an assembly 10 and which comprises a clamp which in the embodiment shown comprises an eccentric member 1 which is rotatable about an axis 2 over a slide member 3 which slides on a slideway defined on a leg portion 5'' of an angle member generally designated 5. The angle member includes means for shifting the clamp which includes the wheel 1 and the slide 3 so as to tension a band 8 which has a loop portion 8' engaged around one of the parts 10-2 which is to be joined together with the other part 10-1 after the bitter end thereof is anchored by a band anchor 9 which is engaged in a slot 9*a* of the leg portion 5' of the angle member 5.

The operation of the inventive device is diagrammatically illustrated in FIG. 1. The structural parts to be joined are encircled by a clamping band 8, with 8' indicating any loop thereby formed. A structural assembly 10 to be exposed to a desired pressure, such as the joint, is enclosed within the loop 8'. FIG. 1 indicates workpieces 10-1 and 10-2, and, by way of example, a glued joint 11 is formed therebetween which must solidfy within a predetermined period of time. The joint assembly 10 is exposed to opposite pressures D1 and D2. In the Z direction, the loop 8' of clamping band 8 is under tension. The two ends of band 8 are fixed to an angle member 5 differently. In the upper part of FIG. 1 the band 8 is passed between a slide 3 and an eccentric bolt 1. Eccentric bolt 1 is pivotable about a pin 2. By pulling band 8 at its free end, eccentric bolt 1 is pivoted without resistance. Pulling in the opposite direction, however, increases the clamping force between slot 3 and eccentric bolt 1. A preliminary clamping of workpieces 10-1, 10-2 together is obtained by simply pulling the band by its free end extending away from the clamping location between bolt 1 and slide 3. This is then followed by a definite tensioning of of band 8 by retracting slide 3 by means of a threaded rod 7 which can produce the desired pull in the Z direction upon being screwed in a fixed nut 6. The surface of angle part 5 with which slide 3 is in contact is designed to avoid any jamming by a torque which might occur. By its other end, band 8 is again attached to the same side of angle 5, at a spaced-apart loction, by means of a band anchor 9.

The device is designed for being usable with workpieces of most various sizes. Only the following dimensions are to be varied for this purpose: The length of the clamping band, and the distance of band anchor 9 on leg 5' of angle 5, from leg 5'' of angle member 5, in other words, the normal spacing of band anchor 9 from angle leg 5''. While embodying the invention, shown in FIG. 1 only to illustrate its function, it is important to minimize or even eliminate undesirable torques by selecting suitable dimensions. As far as possible the closed system of forces produced by the tensioned band should load the clamped workpieces substantially in their principal fiber direction.

FIG. 2 shows an application in which the workpieces are to be glued together in a joint 11 and are to be fixed in place relative to each other during the solidification period. The two joint workpieces 10-1, 10-2 form together a block-like structure having four right-angled edge zones. To one of the edge zones, the tensioning angle 5 of the inventive device namely its legs 5', and 5'' forming a right angle are applied, and clamping band 8 extends from anchor 9 along the two workpieces 10 to be joined, to a first tensioning corner angle 15' and therefrom, in the manner of the loop 8' shown in FIG. 1, to a second tensioning corner angle 15'' and to the clamping mechanism where it is clamped between slide 3 and eccentric bolt 1. The definite desired pull to obtain pressures D1, D2 is then set by turning threaded rod 7 in nut 6.

In a specific embodiment of the invention, tensioning angles 15 form a unit with the device proper. They not only deflect the band, provide sliding surfaces, and act as a band protection, but also guide the band under an adequate force in the desired direction parallel to the workpiece, for example. This minimizes undesirable torques, but also permits guiding of the band at another angle, differing from 90°. Preferably, the tensioning part of the device is applied to a right angle of one of the workpieces, and if this is not possible, an adapter angle is employed having an outer corner of 90° and a suitable inner corner, such as of 75°. Structures having a variety of outer angles can thus be fixed and joined.

As far as necessary, and as provided in the embodiment of FIG. 1, the band sections may be made parallel by providing various locations where the band can be anchored to angle leg 5'. Provided may be slots *9a*, *9b*, *9c* through which clamping band can be passed selectively, depending on the size of the structure. With larger structures such as square frames, angle leg 5' will be too short. In such an instance, a third tensioning angle 15''' is employed in addition, and clamping band 8 is then stretched flush with angle leg 5' to which it is fixed by anchor 9.

In other applications, where screw clamps would no longer help, and where "obstacles in the workpiece itself" occur, clamping band 8 may be trained through provided particular slots, instead of around the workpiece. Joining work may thus be done which earlier was possible only at high expenses.

Figure 3:
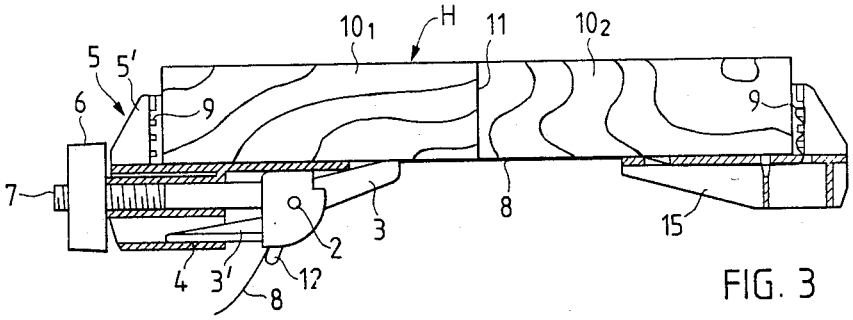
FIG. 3 is a sectional view of another embodiment wherein the inventive device comprises only one tensioning angle and produce no loop around the clamped workpieces.

FIG. 3 shows in more detail another important embodiment of the invention, namely one without a complete clasping, thus only partly encircled. The clamping mechanism comprises a 90° basic angle member 5 to be applied against the workpiece 10-1 which is a wooden part, and equipped with a band anchor 9 which, as compared to FIGS. 1, 2 also takes up torques produced by the pulling band. Eccentric pin 2 of eccentric bolt 1 carries a locking lever 12 with which the clamping band after being tensioned can easily be manually locked. Advantageously, eccentric pin 2 and locking lever 12 are made in one piece in such a way that a rotary motion from 90° to 130° is sufficient for the entire stroke of the eccentric. Only, the stroke must not be too steep against the rotation, since otherwise the unclamping would become progressively easier, with the risk of an inadvertent detachment.

Now, the anchoring 9 on tensioning angle member 15 which is disposed opposite to the clamping mechanism and produces its effect instead of band anchor 9 of angle member 5, which is not in use, makes it possible to apply on the workpieces contact pressures without encircling them entirely. In the present example, the wooden suface H is shown without shape-related obstacles. It will easily be understood, however, that, for example, with workpiece 10-2 having a double or triple thickness and with the dimensions of workpiece 10-1 unchanged, an encircling by the clamping band would necessarily produce a torque unfavorably affecting joint 11. In the shown embodiment, on the other hand, another work, such as painting or coating, may simultaneously be done on surface H which must remain freely accessible for this purpose. It may even happen that an encircling would not be possible at all, for example with surface H extending at a right angle from a wall. For the above reasons, in many instances, the clamping band cannot be trained back to the clamping mechanism. For such applications, the embodiment with a tensioning or holding angle 15 equipped with a band anchor 9 is provided. It should further be noted in connection with FIG. 3 that the clamping device can be used and mounted, with the aid of another person, in any special position with respect to gravity. No limits are set in this regard.

Figure 4:
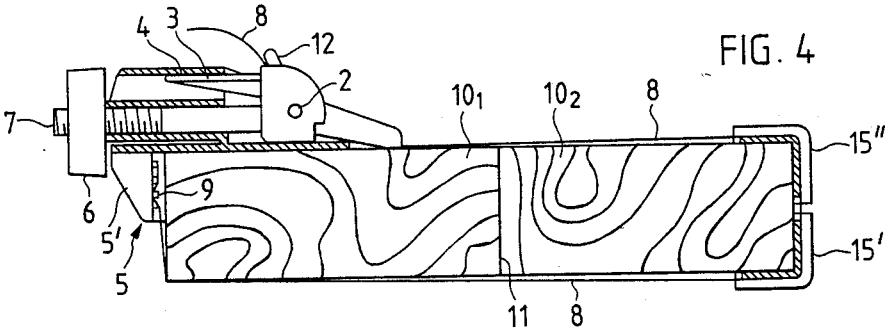
FIG. 4 is a sectional view of another embodiment of the invention in an application wherein the inventive device comprises two tensioning angles and forms a loop around clamped workpieces.

As does FIG. 2, FIG. 4 also shows an application where clamping band 8 encircles the workpieces 10-1, 10-2 to be joined, with both of the fixing or anchoring points 1,3,9 being provided on basic angle 5 of the device. Unlike in FIG. 2, clamping band 8 is run in the direction of angle leg 5 away from anchor 9. Another tightening angle 15 may be provided at the deflecting edge of the workpiece, as was the case with the two angles 15' and 15'' at the opposite edges according to FIG. 2. Clamping band 8 is thus trained away from anchor 9 and around the two tensioning angles 15 and the workpieces 10-1, 10-2 to be joined, to the eccentric clamping mechanism 1,2,3, and manually tightened. Then the firmly applied clamping band is finally tightened by turning threaded rod 7 in nut 6. This tightening may of course also be made proportional, depending on the manner of connection; which means that the present invention does in no way affect the advantages obtainable with prior art arrangements.

Figure 5A:
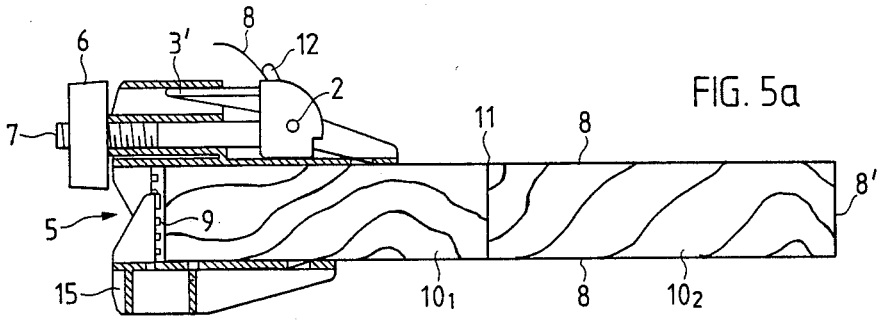
FIG. 5*a* is a sectional view of another embodiment including a single tensioning angle and a loop around the workpieces.
Figure 5B:
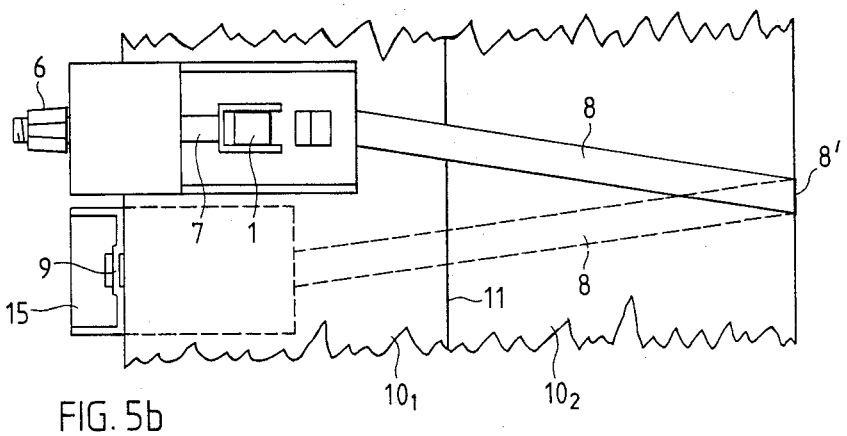
FIG. 5*b* is a top plan view of the embodiment of FIG. 5*a;*.

Another interesting application of the invention is shown in FIGS. 5*a*, 5*b*. For such a use, conventional means would hardly be satisfactory. Be it assumed that for some reason, an application according to FIG. 3 is impossible. For example, only a narrow slot is available at 8' for passing therethrough clamping band 8. As shown, clamping band 8 is trained on the top of the workpieces from the clamping mechanism to the opposite edge, and back on the underside of the workpieces to holding angle 15, to be fixed by anchoring means 9. As described above, the clamping band is correspondingly tightened. The oblique extensions of the clamping band relative to the edges is minimized by providing a minimum lateral distance between the holding angle 15 and the clamping device. Thus, angle 15 and angle 5 engaged over the two outer corners of workpiece 10-1 which is spaced from the joint 11 while bank 8 extends around the corners of piece 10-2.

Figure 6:
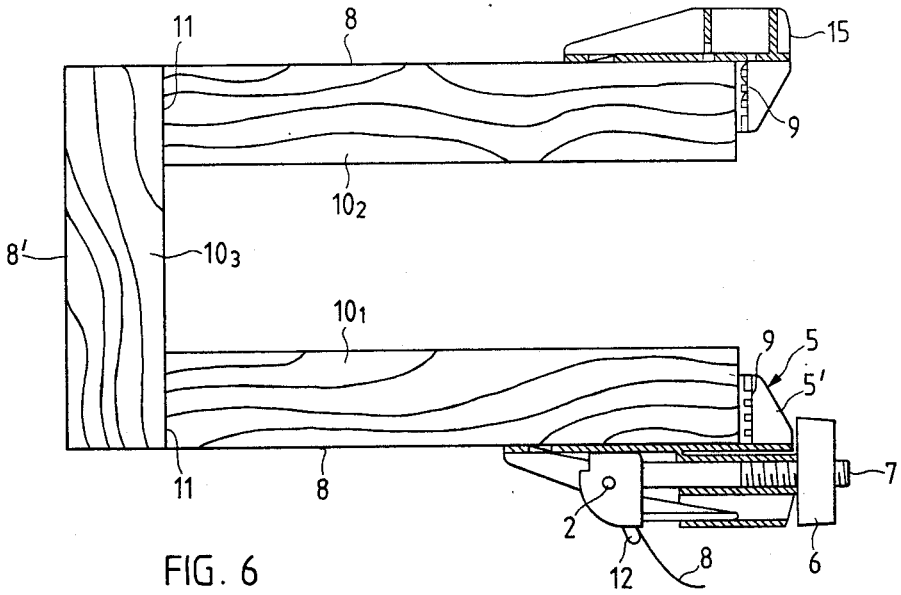
FIG. 6 is a sectional view of another embodiment including a single tensioning angle and a partial loop around the workpieces.

FIG. 6 shows another application with a tensioning angle member 15 and a partial encircling, thus an open loop 8'. Two joints 11 may simultaneously be exposed to contact pressure with the same device. Assuming that FIG. 6 shows a channel-like structure comprising parts 10-1, 10-2, 10-3, then these parts may be of almost any length and may be held assembled by means of a plurality of clamping devices, secured at spaced-apart locations as shown. These few examples illustrate the versatility of the inventive clamping device. Practically no limits are set to the application of the invention if the above-mentioned tensioning angles and adapter angles are employed. The embodiment with the eccentric clamp, slide, threaded rods and nut, clamping band and band angle, may be modified to some extent, without thereby departing from the scope of the invention. Either complete encircling of the workpieces with or without tightening angles is provided, or a partial one, thus an open loop with tightening angles. The clamping is effected by a band which can be tightened and may be of a textile material, or metallic, woven, braided or of solid structure.

While specific embodiments of the invention have been shown and described in detail to illustrate the application of the principles of the invention, it will be understood that the invention may be embodied otherwise without departing from such principles.

What is claimed is:

1. A clamping device and workpiece combination comprising:

a pair of workpieces engaged to each other at a joint and each having a pair of outer corners spaced away form said joint and defining an outer edge spaced away from said joint, said engaged workpieces together having a top surface and a bottom surface;

a tensioning angle engaged over one outer corner of one workpiece, said tensioning angle having a first leg engaged against the outer edge of said one workpiece and a second leg engaged against said top surface of said engaged workpieces;

a holding angle engaged over the other outer corner of said one workpiece, said holding angle having a first leg engaged against said outer edge of said one workpiece and a second leg engaged against said bottom surface of said engaged workpieces, said holding angle having at least one slot therethrough;

a band having a first end portion extending through said slot of said holding angle with an anchoring block connected to said first end portion of said band, said block engaged against said holding angle with tensioning of said band, said band extending over said bottom surface, around said outer corners of the other workpiece, over said top surface and to a second end portion of said band;

band clamping means movably mounted to said tensioning angle for clamping said second end portion of said band to said tightening angle; and band tensioning means connected to said tensioning angle and engaged with said band clamping means for moving said band clamping means on said tensioning angle to tension said band.

2. A combination according to claim 1, wherein said tensioning angle is positioned laterally of said holding angle on said outer edge of said one workpiece in a direction substantially parallel to a direction of said joint whereby said first legs of said tensioning and holding angles extend adjacent each other and parallel to each other over said outer edge of said one workpiece.

3. A combination according to claim 2, wherein said band clamping means comprises a slide engaged against said second leg of said tensioning angle and connected to said band tensioning means for movement on said second leg of said tensioning angle and an eccentric bolt rotatably mounted at a location spaced from said slide and movable on said second leg of said tensioning angle with said slide, said second end portion of said band band being clamped between said slide and said eccentric bolt.

4. A combination according to claim 3, wherein said band tensioning means comprises a threaded rod extending through said first leg of said tensioning angle and being connected to said slide, and a nut threaded to said threaded rod for rotation to move said threaded rod with respect to said first leg for tensioning said band.

* * * * *